US005264311A

United States Patent [19]

Nakano et al.

[11] Patent Number: 5,264,311

[45] Date of Patent: * Nov. 23, 1993

[54] ELECTROPHOTOGRAPHIC TONER

[75] Inventors: Tetsuya Nakano, Nabari; Naruo Yabe, Kobe; Masahide Inoue, Taima; Koichi Tsuyama, Kobe; Yoshitake Shimizu, Kyoto; Mitsushi Kuroki, Kumamoto, all of Japan

[73] Assignee: Mita Industrial Co., Ltd., Osaka, Japan

[ * ] Notice: The portion of the term of this patent subsequent to Dec. 31, 2008 has been disclaimed.

[21] Appl. No.: 570,304

[22] Filed: Aug. 20, 1990

[30] Foreign Application Priority Data

Aug. 21, 1989 [JP] Japan ..... 1-212928

[51] Int. Cl.[5] ..... G03G 9/00

[52] U.S. Cl. ..... 430/109; 430/110; 430/904

[58] Field of Search ..... 430/109, 110, 904

[56] References Cited

U.S. PATENT DOCUMENTS

| | | | |
|---|---|---|---|
| 4,626,488 | 12/1986 | Inoue | 430/109 |
| 4,966,829 | 10/1990 | Yasuda et al. | 430/109 |
| 5,077,168 | 12/1991 | Ogami et al. | 430/109 |
| 5,110,704 | 5/1992 | Inoue et al. | 430/110 |

*Primary Examiner*—Marion E. McCamish
*Assistant Examiner*—Stephen Crossan
*Attorney, Agent, or Firm*—Sherman and Shalloway

[57] ABSTRACT

In an electrophotographic toner, by using as the binder resin a styrene/acrylic resin in which in the gel permeation chromatogram, a high molecular weight peak value appears in a molecular weight region higher than $1\times10^5$, a low molecular weight peak value appears in a molecular weight region of from $2\times10^4$ to 500, a minimum value appears halfways between the two peaks and the ratio (V/P) of the area of the valley to the peak area is lower than 0.3, the internal cohesive force of the binder resin for the toner can be prominently improved while maintaining the low-temperature fixing property and offset resistance at high levels, and pulverization of the toner and formation of the spent toner can be prevented during the developing operation and the durability of the toner can be improved.

13 Claims, 4 Drawing Sheets

HIGH MOLECULAR WEIGHT SIDE LOW MOLECULAR WEIGHT SIDE $\frac{V}{P} = 0.048$ $S_H : S_L = 32:68$

HIGH MOLECULAR WEIGHT SIDE LOW MOLECULAR WEIGHT SIDE $\frac{V}{P} = 0.14$ $S_H : S_L = 25 : 75$ $\frac{V}{P} = 0.309$

SH:SL = 30:70

$\frac{V}{P} = 0.52$ $S_H:S_L = 31:69$

ELECTROPHOTOGRAPHIC TONER

BACKGROUND OF THE INVENTION (1) Field of the Invention

The present invention relates to an electrophotographic toner. More particularly, the present invention relates to an electrophotographic toner having an optimum combination of the fixing property, offset resistance and durability.

(2) Description of the Related Art

A toner is used for developing a charged image in the field of the electrophotographic reproduction or printing. In general, this toner is formed by incorporating a colorant or a charge controlling agent into a binder resin and adjusting the particle size to a predetermined level.

In developing a charged image, the toner is mixed with a magnetic carrier to form a two-component developer, and a magnetic brush of this developer is formed on a developing sleeve having magnetic poles disposed in the interior thereof. This magnetic brush is brought into sliding contact with a photosensitive material carrying a charged image thereon to form a toner image. The formed toner image is transferred onto a paper sheet from the surface of the photosensitive material, and the toner image is fixed on the paper sheet by contact with a fixing hot roller.

Various physical properties have been proposed for the binder resin for the toner. For example, Japanese Unexamined Patent Publication No. 56-16144 discloses a powdery developer comprising a binder resin component composed of a polymer synthesized from a vinyl monomer or a mixture of such polymer, which has a chromatogram determined by the gel permeation chromatography, in which at least one peak value of the molecular weight appears in regions of $10^3$ to $8\times10^4$ and $10^5$ to $2\times10^4$.

Furthermore, Japanese Unexamined Patent Publication No. 60-3644 discloses a toner composition consisting essentially of a binder resin and additives, wherein the binder resin comprises (A) a component having a weight average molecular weight higher than 500,000, (B) a component having a weight average molecular weight of 20,000 to 200,000 and (C) a component having a weight average molecular weight of 1,000 to 20,000.

According to these proposals, by making a high-molecular-weight component and a low-molecular-weight component present in the binder resin for a toner, the blocking resistance, impact resistance and offset resistance are improved while maintaining a good low-temperature fixing property.

However, with recent increase of the copying speed in a copying machine and reduction of the power consumption, when the conventional binder resins for a toner are used, such troubles as insufficient fixing, increased occurrence of the offset phenomenon and shortening of the life of the toner arise, and no effective means for solving these problems has been developed.

SUMMARY OF THE INVENTION

While we made comprehensive research on the molecular weight distribution of the binder resin for a toner and the characteristics of the toner, we found that not only the high-molecular-weight component and low-molecular-weight component contained in the binder resin but also a certain component commonly contained in these components has important influences on the characteristics of the toner under practical developing and fixing conditions.

It is a primary object of the present invention to provide an electrophotographic toner in which the above-mentioned defects of the conventional electrophotographic toners are overcome and which can be easily applied to a high-speed copying machine and a copying machine having a fixing zone of a small power consumption type.

Another object of the present invention is to provide an electrophotographic toner having an optimum combination of the fixing property, offset resistance and durability.

More specfically, in accordance with the present invention, there is provided an electrophotographic toner, which comprises as a binder resin component a styrene/acrylic thermoplastic resin having such a molecular weight distribution that in the gel permeation chromatogram (GPC), a high molecular weight peak value appears in a molecular weight region higher than $1\times10^5$, a low molecular weight peak appears in a molecular weight region of from $2\times10^4$ to 500, a minimum value appears halfways between the two molecular weight peaks, and the ratio of the area of the valley of the minimum value to the sum of the areas of the high molecular weight peak and low molecular weight peak is lower than 0.30.

Incidentally, all of molecular weights referred to in the instant specification and appended claims are weight molecular weights unless otherwise indicated.

In order to attain the objects of the present invention, a specific terpolymer, especially a styrene/methyl methacrylate/butyl acrylate copolymer, is preferably used as the thermoplastic resin.

DETAILED DESCRIPTION OF THE INVENTION

In view of the offset resistance, it is important that in the gel permeation chromatogram, the thermoplastic resin used as the binder resin in the present invention should have a peak value (Ph) of the molecular weight in a high molecular weight region higher than $1\times10^5$, and in view of the low-temperature fixing property, it is important that in the gel permeation chromatogram, the thermoplastic resin should have a peak value (P1) of the molecular weight in a low molecular weight region of from $10^4$ to 500.

However, the high-molecular-weight component reduces the fixing property though this component has an excellent offset resistance. On the other hand, the low-molecular-weight component tends to reduce the offset resistance though this component has an excellent low-temperature fixing property. Accordingly, when the two components are merely mixed, it is pratically very difficult to obtain satisfactory low-temperature fixing property and offset resistance simultaneously. Furthermore, when these high-molecular-weight and low-molecular-weight components are used in combination, the composition of the resin in the toner becomes heterogeneous or the cohesive force is reduced, and the toner is pulverized during the developing operation or a spent toner is formed, with the result that the durability of the toner tends to lower.

In contrast, according to the present invention, by using a resin in which the ratio (V/P) of the area of the valley to the peak area is lower than 0.30, especially lower than 0.20, the internal cohesive force of the toner resin is prominently improved while maintaining the low temperature fixing property and offset resistance at high levels, and hence, the durability of the toner can be increased. Namely, the thermoplastic resin used as the binder resin in the present invention is characterized in that although a great difference of at least $8\times10^4$ resides between the peak value (Ph) on the high molecular weight side and the peak value (Pl) on the low molecular weight side, the content of a molecular weight component common to both the peaks is high.

Figure 1:
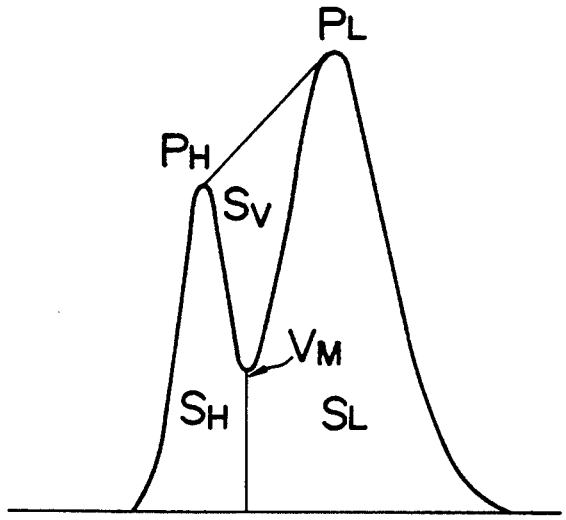
FIG. 1 is a diagram illustrating the method of determining the ratio (V/P) of the area of the valley to the peak area according to the present invention.

Referring to FIG. 1 illustrating the method for determining the ratio (V/P) of the area of the valley to the peak area in the instant specification, the high molecular weight peak value Ph and the low molecular weight peak value Pl are found in this gel permeation chromatogram (GPC), and the minimum value Vm is found halfways between the two peaks. The high molecular weight peak area Sh is measured in the region of a molecular weight higher than the minimum value Vm and the low molecular weight peak area Sl is measured in the region of a molecular weight lower than the minimum value Vm, and the area Sv of the valley is measured below the line connecting both the peak values Ph and Pl. The ratio V/P is calculated from these areas according to the following formula:

$$V/P=Sv/(Sh+Sl) \quad (1)$$

The above-mentioned ratio (V/P) of the area of the valley to the peak area represents the degree of approximation of the double-peak molecular weight distribution curve to the quadrilateral shape. Namely, the smaller is the value V/P, the closer to the quadrilateral shape is the molecular weight distribution curve. This also means that the amount of the intermediate molecular weight component between the high molecular weight component and the low molecular weight component is large within such a range that the double-peak characteristics are not substantially lost.

Figure 2:
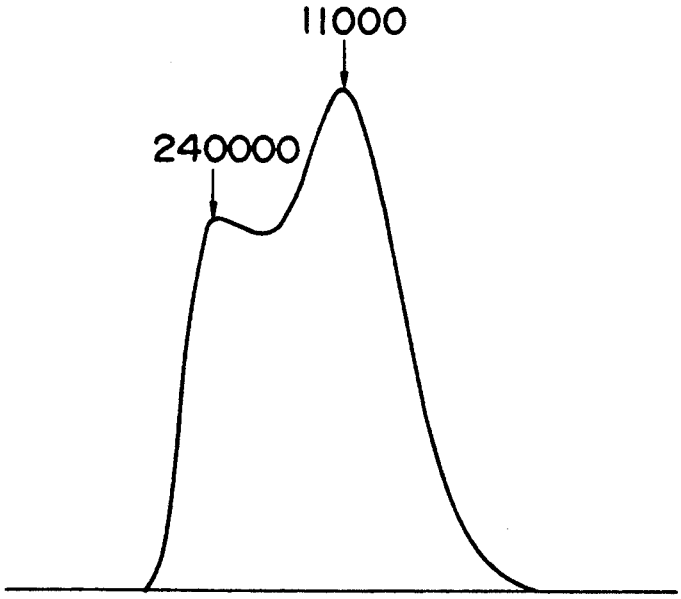
FIGS. 2 and 4 are GPC diagrams showing the molecular weight distributions of resins obtained in the examples of the present invention.

According to the present invention, a resin having a molecular weight distribution which is very approximate to the quadrilateral shape as shown in GPC of FIG. 2 is used, whereby an electrophotographic toner having an optimum combination of the fixing property, offset resistance and durability is obtained.

For the production of a styrene/acrylic copolymer having a molecular weight distribution within the range specified in the present invention, there can be adopted a process in which the dispersion in molecular weight distribution of the low-molecular-weight resin component (Mw/Mn) is broadened, a process in which Mw/Mn of the high-molecular-weight resin component is broadened or a process in which the dispersion (Mw/Mn) in molecular weight distributions of both the resin components are broadened. In short, the intended polymer is obtained by increasing the overlap of the molecular weight distributions of both the resin components. In general, in view of the properties of the toner, it is preferred that the dispersion in molecular weight distribution of the high-molecular-weight resin component Mw/Mn be broadened. It is preferred that the dispersion Mw/Mn of the high-molecular-weight component be 2.7 to 3.7, especially 3.0 to 3.7, and that the dispersion Mw/Mn of the low-molecular-weight component be 1.5 to 2.5, especially 1.8 to 2.2. Moreover, it is preferred that the ratio of Sh to Sl be from 15/85 to 50/50, especially from 20/80 to 45/55, with the proviso that the sum of Sh and Sl is 100.

The styrene/acrylic copolymer used in the present invention is prepared by intimately melt-blending a plurality of styrene/acrylic copolymers differing in the molecular weight distribution so that the molecular weight distribution is within the above-mentioned range, or according to the two-stage polymerization process.

Figure 3:
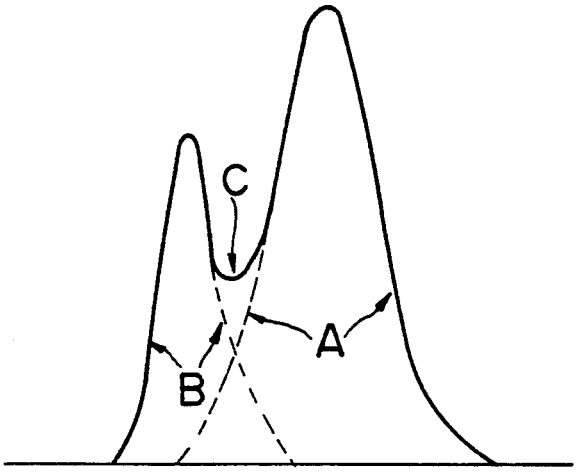
FIG. 3 is a diagram illustrating the formation of a resin having a molecular weight distribution defined in the present invention.

For example, as shown in FIG. 3, if a styrene/acrylic copolymer (having a low molecular weight) having a molecular weight distribution indicated by curve A is melt-blended with an equal amount of a styrene/acrylic copolymer (having a high molecular weight) having a molecular weight distribution indicated by curve B, a styrene/acrylic copolymer having a molecular weight distribution included within the range specified in the present invention, which is indicated by curve C, can be obtained.

In general, according to the suspension polymerization or emulsion polymerization process, a polymer having a high molecular weight is more readily formed than according to the solution polymerization process. Therefore, if the suspension or emulsion polymerization and the solution polymerization are carried out in this order or the reverse order in the production of a styrene/acrylic copolymer to effect the multi-stage polymerization and the molecular weight is adjusted to each stage, a styrene/acrylic copolymer having a molecular weight distribution included within the range specified in the present invention can be obtained. The molecular weight and the molecular weight distribution can be appropriately adjusted according to the kind and amount of the initiator, the kind of the solvent participating in the chain transfer and the kind of the dispersant or emulsifier.

As the styrene type monomer, there can be used not only styrene but also vinyltoluene and α-methylstyrene. As the acrylic monomer, there can be used acrylic monomers represented by the following formula:

$$CH_2{=}\overset{\overset{R_1}{|}}{C}{-}CO{-}O{-}R_2 \quad (2)$$

wherein $R_1$ represents a hydrogen atom or a lower alkyl group, and $R_2$ represents a hydrogen atom, a hydrocarbon group having up to 12 carbon atoms, a hydroxyalkyl group, a vinyl ester group or an amino alkyl group, such as acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, butyl δ-hydroxyacrylate, ethyl β-hydroxymethacrylate, propyl γ-aminoacrylate, propyl γ-N,N-diethylaminoacrylate, ethylene glycol dimethacrylate and tetraethylene glycol dimethacrylate.

The styrene/acrylic copolymer suitable for attaining the objects of the present invention is a styrene (St)/methyl methacrylate (MMA)/butyl acrylate (BA) copolymer resin, and a copolymer resin of this type, in which the St content is 75 to 85% by weight, the MMA content is 0.5 to 5% by weight and the BA content is 10 to 20% by weight, is especially preferably used.

The electrophotographic toner of the present invention can be prepared according to a known recipe by a known preparation process, so far as a styrene/acrylic thermoplastic resin having the above-mentioned molecular weight distribution is contained as the binder resin component.

Various colorants for coloring the toner, that is, various pigments and dyes (hereinafter referred to as "coloring pigments"), can be used for the toner of the present invention.

Suitable examples of the coloring pigment are as follows.

Black pigments:

Carbon black, acetylene black, lamp black and aniline black.

Yellow pigments:

Chrome yellow, zinc yellow, cadmium yellow, yellow iron oxide, Mineral Fast Yellow, nickel titanium yellow, naples yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Lake.

Orange pigments:

Chrome orange, molybdenum orange, Permanent Orange GTR, Pyrazolone Orange, Vulcan Orange, Indanthrene Brilliant Orange RK, Benzidine Orange G and Indanthrene Brilliant Orange GK.

Red pigments:

Red iron oxide, cadmium red, red lead, mercury cadmium sulfide, Permanent Red 4R, Lithol Red, Pyrazolone Red, Watchung Red calcium salt, Lake Red D, Brilliant Carmine 6B, Eosine Lake, Rhodamine Lake B, Alizarin Lake and Brilliant Carmine 3B.

Violet pigments:

Manganese violet, Fast Violet B and Methyl Violet Lake.

Blue pigments:

Iron blue, cobalt blue, Alkali Blue Lake, Victoria Blue Lake, Phthalocyanine Blue, metal-free Phthalocyanine Blue, partially chlorinated Phthalocyanine Blue, Fast Sky Blue and Indanthrene Blue BC.

Green pigments:

Chrome green, chromium oxide, Pigment Green B, Malachite Green Lake and Fanal Yellow Green G.

White pigments:

Zinc flower, titanium oxide, antimony white and zinc sulfide.

Extender pigments:

Baryte powder, barium carbonate, clay, silica, white carbon, talc and alumina white.

As the magnetic pigment, there have been used triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_4$), copper iron oxide ($CuFe_2O_4$), lead iron oxide ($PbFe_{12}O_{19}$), neodium iron oxide ($NdFeO_3$), barium iron oxide ($AbFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Fine powders of these known magnetic materials can optionally be used in the present invention.

The pigment is incorporated in an amount of 1 to 80% by weight, especially 5 to 60% by weight, based on the toner.

A known charge controlling agent, for example, an oil-soluble dye such as Nigrosine Base (CI 5045), Oil Black (CI 26150) or Spiron Black, metal compounds of salicylic acid, alkyl salicylic acid and naphtoic acid, metal complex salt dyes of the 1:1 type or the 2:1 type, can be incorporated into the toner of the present invention. Furthermore, in order to attain an offset-preventing effect, a release agent such as low-molecular-weight polyethylene, low-molecular-weight polypropylene, a wax or a silicone oil can be incorporated into the toner of the present invention.

It is preferred that the particle size of the toner be 5 to 20 μm, especially 7 to 13 μm. The toner having such a particle size can be obtained through pulverization and classification or by the suspension polymerization process or the like. Finely divided hydrophobic silica or carbon black can be sprinkled on the surfaces of toner particles so as to improve the flowability of the toner.

This toner is mixed with a magnetic carrier such as a ferrite or iron powder to form a two-component type developer, and this two-component type developer can be used for formation of images through development of electrostatic latent images, transfer and fixation.

The present invention will now be described in detail with reference to the following examples that by no means limit the scope of the invention.

EXAMPLE 1

Figure 4:
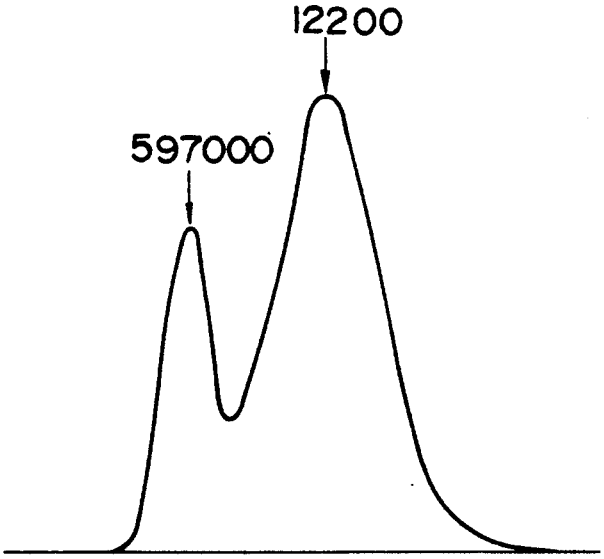

A styrene (St)/methyl methacrylate (MMA)/butyl acrylate (BA) copolymer (ST/MMA/BA=80/5/15), in which the peak value on the high molecular weight side was 597,000 with Mw/Mn being 3.1 and the peak value on the low molecular weight side was 12,200 with Mw/Mn being 1.95, and which had GPC as shown in FIG. 4 (V/P=0.14, Sh/Sl=25/75), was used as the binder resin. First, 8 parts by weight of carbon black as the colorant, 1 part by weight of a dye of the negative polarity as the charge controlling agent and 1 part by weight of low-molecular-weight polyethylene were incorporated into 100 parts by weight of the binder resin, and the mixture was melt-kneaded, cooled, pulverized and classified to form a toner having a median diameter of 12 μm based on the volume. Then, 0.2 part by weight of hydrophobic silica was added to 100 parts by weight of the formed toner, and the mixture was mixed with a ferrite carrier having an average particle size of 80 μm so that the toner concentration was 4.0% by weight. By using the obtained developer, the copying test of obtaining 20,000 prints was carried out in an electrophotographic copying machine (Model DC-5585 supplied by Mita Industrial Co.). Furthermore, the fixing property and blocking resistance were tested according to the following methods.

At the fixing property test, a remodeled machine of Model DC-5585 (the hot press roll fixing method was adopted) was used, and the set temperature of the hot roller was elevated from 140° C. stepwise at intervals of 2.5° C. Transfer sheets having a toner image formed thereon were passed through the hot roller. An adhesive tape was applied to the formed fixed image of each transfer sheet and the adhesive tape was then peeled. The image density of the fixed image was measured by a reflection densitometer (supplied by Tokyo Denshoku) before and after the peeling. The temperature at which the fixing ratio calculated by the following formula was 90% was determined as the lowest fixing temperature, and the high-temperature offset-occurring temperature was similarly determined:

$$\text{Fixing ratio} = \frac{\text{image density after peeling}}{\text{image density before peeling}} \times 100$$

At the blocking resistance test, 20 g of the toner was charged in a glass cylinder having an inner diameter of 26.5 mm in an oven maintained at 60° C., and a balance weight of 100 g was placed on the toner and the toner was allowed to stand still in this state for 30 minutes. Then, the cylinder was drawn out and it was checked whether or not the toner crumbled.

The impact resistance was evaluated based on the amount of the spent toner formed after the continuous reproduction of 20,000 prints.

The obtained results are shown in Table 1.

EXAMPLE 2

A toner was prepared in the same manner as described in Example 1 except that a styrene (St)/methyl methacrylate (MMA)/butyl acrylate (BA) copolymer (St/MMA/BA=75/5/20), in which the peak value on the high molecular weight side was 240,000 with Mw/Mn being 3.0 and the peak value on the low molecular weight side was 11,000 with Mw/Mn being 2.2 and which had GPC as shown in FIG. 2 (V/P=0.048, Sh/Sl=32/68), was used as the binder resin. Various tests were carried out in the same manner as described in Example 1. The obtained results are shown in Table 1.

COMPARATIVE EXAMPLE 1

Figure 5:
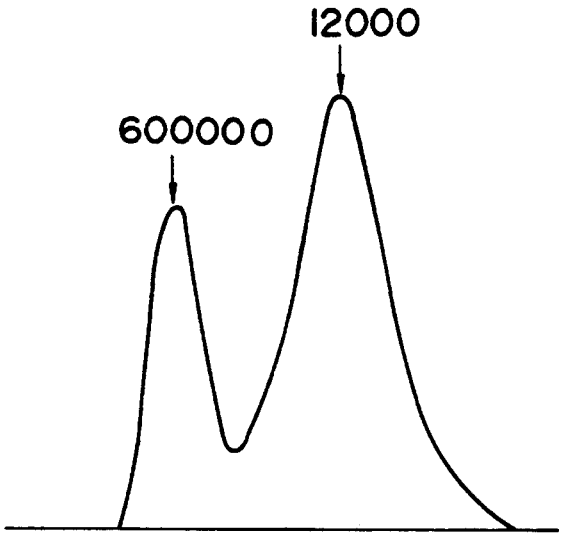
FIGS. 5, 6 and 7 are GPC diagrams illustrating the molecular weight distributions of resins obtained in the comparative examples.

A toner was prepared in the same manner as described in Example 1 except that a styrene (St)/methyl methacrylate (MMA)/butyl acrylate (BA) copolymer (St/MMA/BA=83/5/12), in which the peak value on the high molecular weight side was 600,000 with Mw/Mn being 3.0 and the peak value on the low molecular weight side was 12,000 with Mw/Mn being 2.0 and which had GPC as shown in FIG. 5 (V/P=0.309, Sh/Sl=30/70), was used as the binder resin. Various tests were carried out in the same manner as described in Example 1. The obtained results are shown in Table 1.

COMPARATIVE EXAMPLE 2

Figure 6:
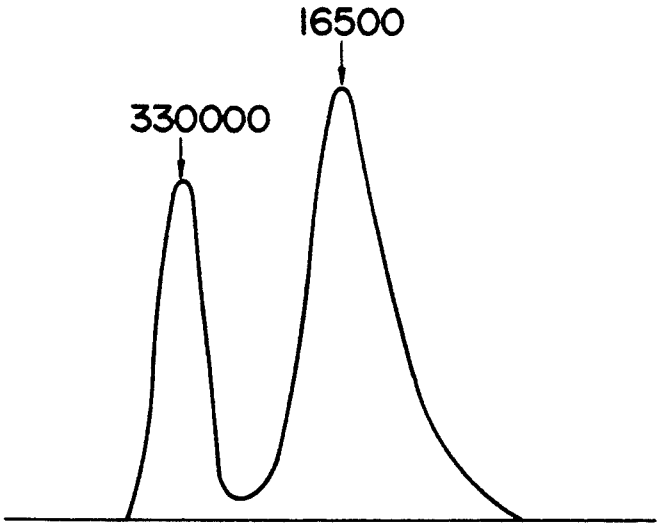

A toner was prepared in the same manner as described in Example 1 except that a styrene (St)/methyl methacrylate (MMA)/butyl acrylate (BA) copolymer (St/MMA/BA=80/5/15), in which the peak value on the high molecular weight side was 330,000 with Mw/Mn being 2.9 and the peak value on the low molecular weight side was 16,500 with Mw/Mn being 2.2 and which had GPC as shown in FIG. 6 (V/P=0.521, Sh/Sl=31/69), was used as the binder resin. Various tests were carried out in the same manner as described in Example 1. The obtained results are shown in Table 1.

COMPARATIVE EXAMPLE 3

Figure 7:
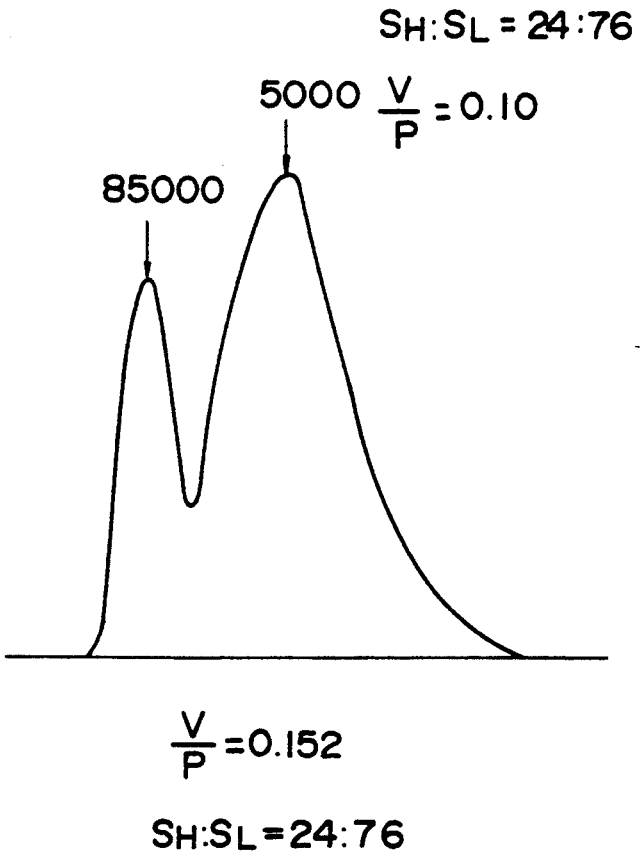

A toner was prepared in the same manner as described in Example 1 except that a styrene (St)/methyl methacrylate (MMA)/butyl acrylate (BA) copolymer (St/MMA/BA=82/4/14), in which the peak value on the high molecular weight side was 85,000 with Mw/Mn being 3.0 and the peak value on the low molecular weight side was 5,000 with Mw/Mn being 2.3 and which had GPC as shown in FIG. 7 (V/P=0.15, Sh/Sl=24/76), was used as the binder resin. Various tests were carried out in the same manner as described in Example 1. The obtained results are shown in Table 1.

TABLE 1

| | Properties of Resin | | | | Test Results | | | |
|---|---|---|---|---|---|---|---|---|
| | V/P | Sh/Sl | Sh | Sl | lowest fixing temperature (°C.) | high-temperature offset-occurring temperature (°C.) | blocking resistance | amount(%) of spent toner |
| Example 1 | 0.140 | 25:75 | 597000 | 12200 | 150 | 190 | good | 0.15 |
| Example 2 | 0.048 | 32:68 | 240000 | 11000 | 145 | 185 | good | 0.13 |
| Comparative Example 1 | 0.309 | 30:70 | 600000 | 12000 | 160 | 180 | fair | 0.85 |
| Comparative Example 2 | 0.521 | 31:69 | 330000 | 16500 | 165 | 180 | bad | 1.05 |
| Comparative Example 3 | 0.152 | 24:76 | 85000 | 5000 | 150 | 180 | bad | 1.10 |

From the results shown in Table 1, the following can be seen.

In case of the toners of the examples, good images [the image density (ID) was at least 1.3, the fog density (FD) was lower than 0.003 and the resolving power was at least 6.3 lines/mm] were obtained in all of 20,000 prints, and the difference between the lowest fixing temperature and the high-temperature offset-occurring temperature was large and a fixing-possible temperature range was broad. Moreover, in case of the toners of the examples, at the blocking resistance test, agglomeration of toner particles was not caused and the amount of the spent toner was small, and the blocking resistance and impact resistance were excellent.

The toners of the comparative examples were inferior to the toners of the examples in the fixing property, blocking resistance and impact resistance, and it was confirmed that if any one of the position of the peak on the high molecular weight side, the position of the peak on the low molecular weight side and the value of the V/P ratio is outside the range specified in the present invention, an excellent toner cannot be obtained.

As is apparent from the foregoing description, by using as the binder resin a styrene/acrylic resin in which in the gel permeation chromatogram, a high molecular weight peak value appears in a molecular weight region higher than $1\times10^5$, a low molecular weight peak value appears in a molecular weight region of from $2\times10^4$ to 500, a minimum value appears halfways between the two peaks and the ratio (V/P) of the area of the valley to the peak area is lower than 0.3, the internal cohesive force of the binder resin for a toner can be prominently improved while maintaining the low-temperature fixing property and offset resistance at high levels, and pulverization of the toner and formation of the spent toner can be prevented during the developing operation and the durability of the toner can be improved.

We claim:

1. An electrophotographic toner, which comprises as a binder resin component a styrene/acrylic thermoplastic resin having such a molecular weight distribution that in the gel permeation chromatogram (GPC), a high molecular weight peak value appears in a molecular weight region higher than $1\times10^5$, a low molecular weight peak appears in a molecular weight region of from $2\times10^4$ to 500, a minimum value appears halfways between the two molecular weight peaks and the ratio of the areas of the valley of the minimum value to the sum of the areas of the high molecular weight peak and low molecular weight peak is lower than 0.30.

2. A toner as set forth in claim 1, wherein the copolymer has a styrene content of 75 to 85% by weight, a methyl methacrylate content of 0.5 to 5% by weight and a butyl acrylate content of 10 to 20% by weight.

3. A toner as set forth in claim 1, wherein the molecular weight distribution (Mw/Mn) of the high-molecular-weight component is in the range of from 2.7 to 3.7 and the molecular weight distribution (Mw/Mn) of the low-molecular-weight component is in the range of from 1.5 to 2.5.

4. A toner as set forth in claim 1, wherein the ratio of the high molecular weight peak area (Sh) to the low molecular weight peak area (Sl) is in the range of from 15/85 to 50/50 with the proviso that the sum of Sh and Sl is 100.

5. An electrophotographic toner, which comprises as a binder resin component a styrene/acrylic thermoplastic resin having such a molecular weight distribution that in the gel permeation chromatogram (GPC), a high molecular weight peak value appears in a molecular weight region higher than $1\times10^5$, a low molecular weight peak appears in a molecular weight region of from $2\times10^4$ to 500, a minimum value appears halfway between the two molecular weight peaks and the ratio of the area of the valley of the minimum value to the sum of the areas of the high molecular weight peak and low molecular weight peak is lower than 0.30, and further providing that there is a difference of at least $8\times10^4$ between the peak value in the high molecular weight region and the peak value in the low molecular weight region.

6. A toner as set forth in claim 5, wherein the ratio of the area of the valley of the minimum value to the sum of the areas of the high molecular weight peak and the low molecular weight peak is lower than 0.20.

7. A toner as set forth in claim 5, wherein the ratio of the high molecular weight peak area (Sh) to the low molecular weight peak area (Sl) is in the range of from 20/80 to 45/55 with the provisio that the sum of Sh and Sl is 100.

8. An electrophotographic toner which comprises as a binder resin component styrene/methyl methacrylate/butyl acrylate copolymer thermoplastic resin and having such a molecular weight distribution that in the gel permeation chromatogram (GPC), a high molecular weight peak value appears in a molecular weight region higher than $1\times10^5$, a low molecular weight peak appears in a molecular weight region of from $2\times10^4$ to 500, a minimum value appears halfway between the two molecular weight peaks and the ratio of the area of the valley of the minimum value to the sum of the areas of the high molecular weight peak and low molecular weight peak is lower than 0.30.

9. A toner as set forth in claim 8 wherein the copolymer has a styrene content of 75 to 85% by weight, a methyl methacrylate content of 0.5 to 5% by weight and a butyl acrylate content of 10 to 20% by weight.

10. A toner as set forth in claim 8 wherein the ratio of the high molecular weight peak area (Sh) to the low molecular weight peak area (Sl) is in the range of from 15/85 to 50/50 with the proviso that the sum of Sh and Sl is 100.

11. An electrophotographic toner which comprises as a binder resin component styrene/methyl methacrylate/butyl acrylate copolymer thermoplastic resin, and wherein the copolymer has a styrene content of 75 to 85% by weight, a methyl methacrylate content of 0.5 to 5% by weight and a butyl acrylate content of 10 to 20% by weight, and having such a molecular weight distribution that in the gel permeation chromatogram (GPC), a high molecular weight peak value appears in a molecular weight region higher than $1\times10^5$, a low molecular weight peak appears in a molecular weight region of from $2\times10^4$ to 500, a minimum value appears halfway between the two molecular weight peaks and the ratio of the area of the valley of the minimum value to the sum of the areas of the high molecular weight peak and low molecular weight peak is lower than 0.30, and further providing that there is a difference of at least $8\times10^4$ between the peak value in the high molecular weight region and the peak value in the low molecular weight region.

12. A toner as set forth in claim 11, wherein the ratio of the area of the valley of the minimum value to the sum of the areas of the high molecular weight peak and the low molecular weight peak is lower than 0.20.

13. A toner as set forth in claim 12, wherein the ratio of the high molecular weight peak area (Sh) to the low molecular weight peak area (Sl) is in the range of from 20/80 to 45/55 with the proviso that the sum of Sh and Sl is 100.

* * * * *